US008381342B2

(12) United States Patent
Pollett

(10) Patent No.: US 8,381,342 B2
(45) Date of Patent: Feb. 26, 2013

(54) WASHING MACHINE SPRAY DEVICE AND METHOD

(75) Inventor: James Quentin Pollett, Louisville, KY (US)

(73) Assignee: General Electric Company, Schenectady, NY (US)

( * ) Notice: Subject to any disclaimer, the term of this patent is extended or adjusted under 35 U.S.C. 154(b) by 379 days.

(21) Appl. No.: 12/050,855

(22) Filed: Mar. 18, 2008

(65) Prior Publication Data

US 2009/0235466 A1 Sep. 24, 2009

(51) Int. Cl.
*D06F 35/00* (2006.01)
*D06F 39/08* (2006.01)

(52) U.S. Cl. ..... 8/159

(58) Field of Classification Search ..... 8/158, 159; 68/23.3

See application file for complete search history.

(56) References Cited

U.S. PATENT DOCUMENTS 3,740,975 A * 6/1973 Cornelius ..... 68/18 F
4,410,329 A * 10/1983 Blevins et al. ..... 8/158
4,987,627 A * 1/1991 Cur et al. ..... 8/158
5,167,722 A * 12/1992 Pastryk et al. ..... 134/33
6,212,722 B1 * 4/2001 Pinkowski et al. ..... 8/158
6,269,666 B1 * 8/2001 Whah et al. ..... 68/12.02
6,584,811 B2 * 7/2003 Whah et al. ..... 68/12.04
7,062,810 B2 * 6/2006 Hardaway et al. ..... 8/159
2003/0089139 A1 5/2003 Orszulik
2004/0010860 A1 1/2004 Johanski et al.
2004/0237212 A1 * 12/2004 Shaffer ..... 8/159
2005/0000033 A1 * 1/2005 Park et al. ..... 8/159
2007/0061981 A1 * 3/2007 La Belle et al. ..... 8/158
2007/0067920 A1 3/2007 Zaccone
2007/0084000 A1 * 4/2007 Bernardino et al. ..... 8/158
2007/0107138 A1 * 5/2007 Bernardino et al. ..... 8/158

FOREIGN PATENT DOCUMENTS

JP 2002273093 * 9/2002

OTHER PUBLICATIONS

Machine translation of JP2002-273093 (Sep. 2002).*

* cited by examiner

*Primary Examiner* — Joseph L Perrin
(74) *Attorney, Agent, or Firm* — Fay Sharpe LLP

(57) ABSTRACT

A washing machine includes a cabinet, a tub positioned within the cabinet, a basket rotatably supported within the tub, and a spray device mounted within the cabinet and positioned to introduce water into the basket. The spray device sprays an initial amount of water onto a wash load received in the basket. The rotatable basket is rotated to redistribute the wash load radially outwardly in the basket. The wash load within the basket is washed after the rotatable basket is rotated to redistribute the wash load.

10 Claims, 5 Drawing Sheets

WASHING MACHINE SPRAY DEVICE AND METHOD

BACKGROUND

The present disclosure generally relates to washing machines, and more particularly relates to a washing machine spray device and method. In one embodiment, a spray device is operated to spray an initial amount of water onto a wash load, which is rotated to redistribute the wash load radially outwardly to allow for a rollover action to be imparted to the wash load more quickly. The washing machine spray device and method will be described with particular reference to this embodiment, but it is to be appreciated that it is also amenable to other like applications.

Conventional vertical axis washing machines are known to include a center agitator disposed within a vertical axis wash basket, which is rotatably supported within a tub. Typically, the agitator extends upwardly from the bottom wall of the basket and has a height that is substantially equal to the height of the wash basket. A desirable clothes movement pattern in these types of washing machines is a rollover action wherein a clothes load, or individual items thereof, are moved down along the agitator barrel, then radially outward, and finally upward along an outer peripheral wall of the basket.

Also known is a second type of vertical axis washing machine wherein a pulsator or disc-like impeller is provided along the bottom wall of the wash basket, the basket being rotatably supported within the tub of the washing machine. It is known to operate the pulsator of these types of washing machines in a manner which produces the rollover pattern discussed above, but also in a manner wherein a wash load, or individual items thereof, are directed upward along a vertical axis of the wash basket, then radially outward, and finally downward along an outer peripheral wall of the basket.

One method for the measuring quality of these latter types of washing machines is how fast they can impart rollover or turnover to the clothes load, which is known to yield a better wash and better wear performance on the wash load, or items thereof. The importance of rolling over clothes faster is enhanced in pulsator types of washing machines because the wash load, or items thereof, will tend to wear faster where rollover does not exist or is slower in coming about. In other words, a faster turnover promotes less wear with any particular portion of the clothes load because there is less time that any one portion of the load is in direct contact with the pulsator.

Some attempts to address this problem have been to vary the agitating profiles of the pulsator. For example, an initial vigorous pulsator stroke profile can be used and then followed by a normal stroke profile. The vigorous stroke profile is thought to promote more turnover, but has the drawback of being rougher on the clothes. Other attempts to address this problem are by the use of random stroke profiles for the pulsator.

SUMMARY

According to one aspect, a method for redistributing a wash load held in a rotatable basket of a washing machine is provided for promoting turnover. More particularly, in accordance with this aspect, an initial amount of water is sprayed onto the wash load from a spray device of the washing machine. The rotatable basket is rotated to redistribute the wash load radially outwardly in the basket. After the rotatable basket has been rotated to redistribute the wash load, the wash load within the basket is washed.

According to another aspect, a washing machine is provided. More particularly, in accordance with this aspect, the washing machine includes a cabinet, a tub positioned within the cabinet, and a basket rotatably supported within the tub. A spray device is mounted within the cabinet and positioned to introduce water into the basket. A drive system is provided for rotating the basket. A controller is operatively coupled to the drive system and the spray device. The controller is configured to operate the spray device to spray an initial amount of water onto a wash load received in the basket and to operate the drive system to rotate the basket to urge the wash load radially outwardly within the basket prior to washing the wash load.

According to yet another, a method for redistributing a wash load held in a rotatable basket of a washing machine is provided for promoting more rapid turnover. More particularly, in accordance with this aspect, a mass is imparted to the wash load held in the rotatable basket. After the mass is imparted to the wash load, the wash load is redistributed centrifugally within the basket. After the redistributing, an inverted toroidal rollover action is imparted to the wash load for washing thereof.

DETAILED DESCRIPTION OF THE INVENTION

Figure 1:
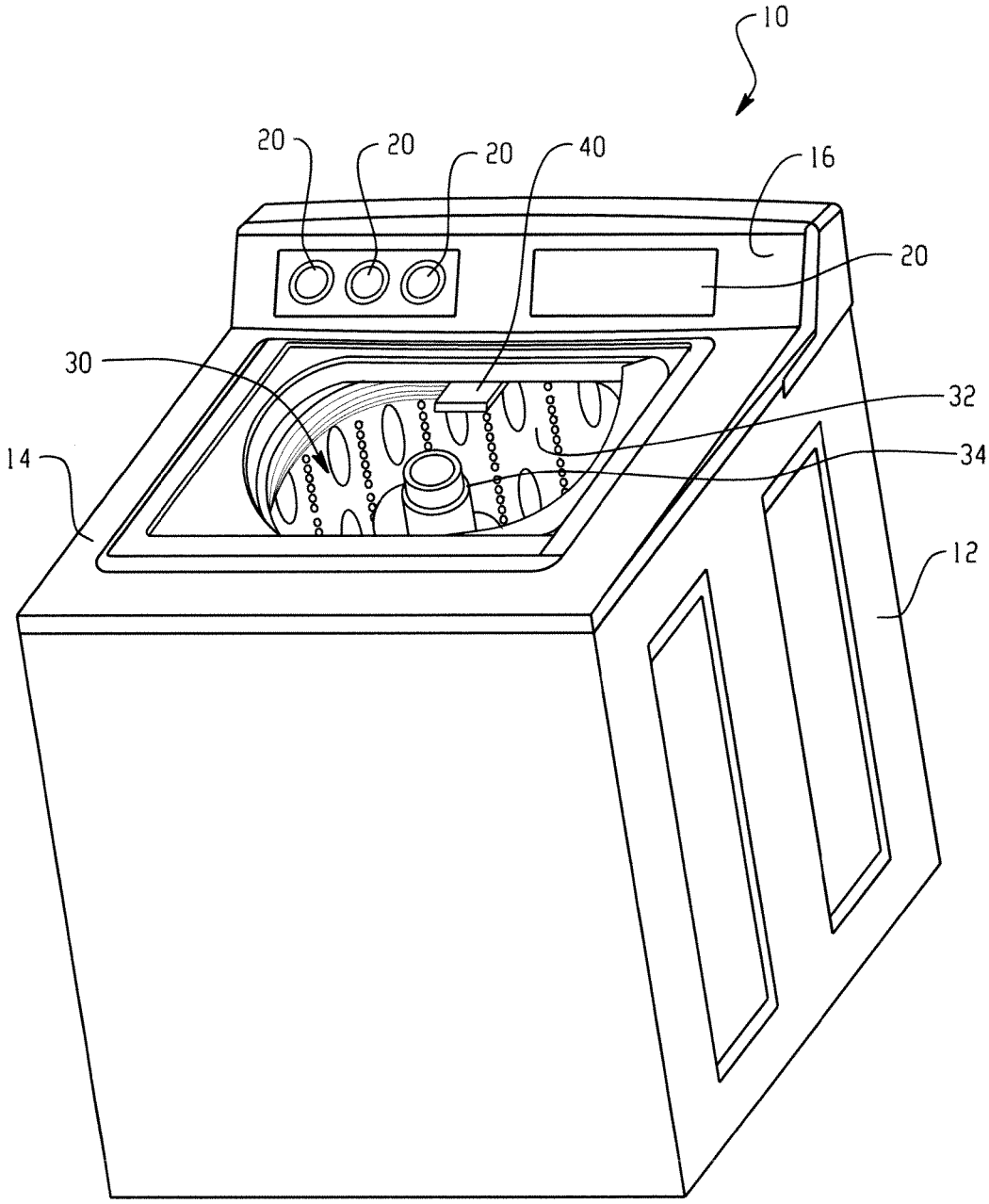
FIG. 1 is a perspective view of a washing machine having a spray fill device.

Referring now to the drawings wherein the showings are for purposes of illustrating one or more exemplary embodiments, FIG. 1 shows a vertical axis washing machine 10 including a cabinet 12 and a cover 14. A backsplash 16 extends from the cover 14, and a variety of appliance control input selectors 20 can be coupled to the backsplash 16. As is known and understood by those skilled in the art, the input selectors 20 can form a user interface input allowing for operator selection of machine cycles and features.

As shown, the washing machine 10 includes a wash tub 30 located or positioned within the cabinet 12, and a wash basket 32 movably disposed and rotatably mounted within the wash tub 30. As shown, the basket 32 can include a plurality of apertures or perforations to facilitate fluid communication between an interior 100 (FIG. 2) of the basket 32 and the wash tub 30. An agitator, impeller, or oscillatory basket mechanism 34 can be rotatably positioned in the basket 32 on a vertical axis for imparting motion to articles and liquid within the basket 32. In FIG. 1, element 34 is shown as an agitator oriented to rotate about a vertical axis. A spray fill device 40 is mounted within the cabinet 12 and positioned above the basket 32 for introducing water into the basket 32.

Figure 2:
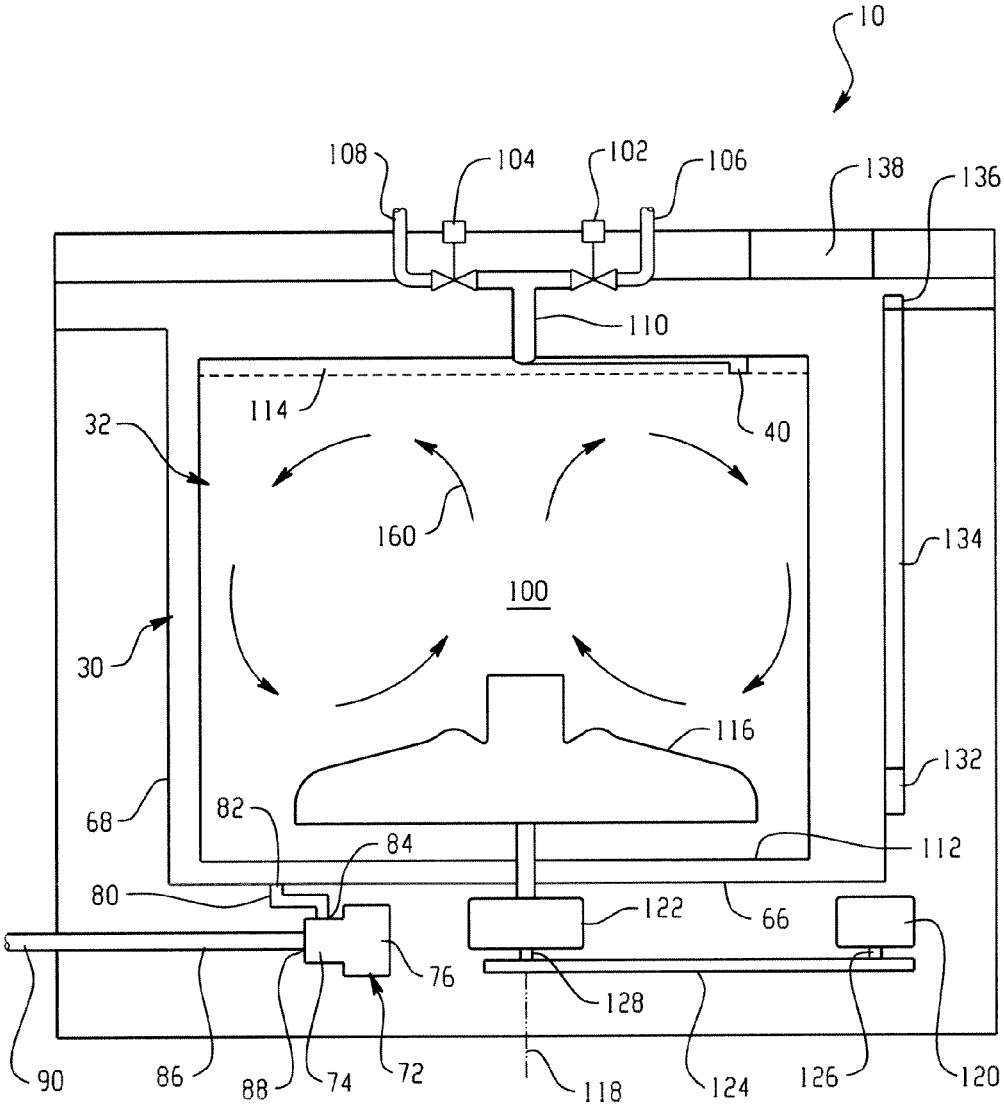
FIG. 2 is an elevational schematic view of the washing machine shown in FIG. 1.

With reference to FIG. 2, the tub 30 includes a bottom wall 66 and a side wall 68, and the basket 32 is rotatably mounted or supported within the tub 30 in spaced apart relation from the tub bottom wall 66 and side wall 68. A pump assembly 72 is located beneath the tub 30 and the basket 32 for gravity assisted flow when draining the tub 30. Pump assembly 72 includes a pump 74, a motor 76, and in an exemplary embodiment a motor fan (not shown). A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with the outlet 90.

A hot liquid valve 102 and a cold liquid valve 104 deliver fluid, such as water, to the basket 32 and wash tub 30 through a respective hot liquid hose 106 and a cold liquid hose 108. Liquid valves 102,104 and liquid hoses 106,108 together form a liquid supply connection for the washing machine 10 and, when connected to a building plumbing system (not shown), provide a water supply for use in the washing machine 10. Liquid valves 102,104 and liquid hoses 106,108 are connected to a basket inlet tube 110, and fluid is dispersed from the inlet tube 110 through the spray fill device 40.

In an alternate embodiment, a known spray fill conduit 114 (shown in phantom in FIG. 2) can be employed in lieu of the spray device 40. Along the length of the spray fill conduit 114 can be a plurality of openings arranged in a predetermined pattern to direct incoming streams of water in a downward tangential manner towards articles in the basket 32. The openings in the conduit 114 can be located a predetermined distance apart from one another to produce an overlapping coverage of liquid streams into the basket 32. Articles in the basket 32 may therefore be uniformly wetted even when the basket is maintained in a stationary position.

With reference to FIG. 2, the washing machine 10 is shown with the depicted agitator 34 of FIG. 1 replaced by an impeller or pulsator 116. Like the agitator 34, the pulsator 116 is oriented to rotate about a vertical axis, such as axis 118, for imparting motion to articles and liquid within the basket 32. In an exemplary embodiment, the basket 32 and pulsator 116 are driven by a motor 120 through a transmission and clutch system 122. A transmission belt 124 is coupled to respective pulleys of a motor output shaft 126 and a transmission input shaft 128. Thus, as motor output shaft 126 is rotated, transmission input shaft 128 is also rotated. Clutch system 122 facilitates driving engagement of the basket 32 and the pulsator 116 for rotatable movement within the wash tub 30, and clutch system 122 facilitates relative rotation of the basket 32 and the pulsator 116 for selected portions of wash cycles. Motor 120, transmission and clutch system 122 and belt 124 can collectively be referred to as a machine drive system, the machine drive system for rotating the basket 32 and/or the pulsator 116. As shown, the pulsator 116 is disposed adjacent bottom 112 of the wash basket 32 and drivingly connected to the illustrated drive system. As will be appreciated by those of skill in the art, the drive system 122,124 of the illustrated embodiment can be replaced by any other suitable drive system that may or may not include a transmission, clutch, or belt.

The washing machine 10 can also include a brake assembly (not shown) selectively applied or released for respectively maintaining the basket 32 in a stationary position within the tub 30 or for allowing the basket 32 to spin within the tub 30. Pump assembly 72 is selectively activated to remove liquid from the basket 32 and the tub 30 through drain outlet 90 during appropriate points in washing cycles as machine 10 is used. In an exemplary embodiment, the washing machine also includes a reservoir 132, a tube 134 and a pressure sensor 136. As fluid levels rise in the wash tub 30, air is trapped in the reservoir 132 creating a pressure in tube 134 that pressure sensor 136 monitors. Liquid levels, and more specifically, changes in liquid levels in the wash tub 30 may therefore be sensed, for example, to indicate laundry loads and to facilitate associated control decisions. In further alternative embodiments, load size and cycle effectiveness can be determined or evaluated using other known indicia, such as motor spin, torque, load weight, motor current, voltage, current phase shifts, etc.

Operation of the machine 10 is controlled by a controller 138 which is operatively connected to the user interface input located on the washing machine backsplash 16 for user manipulation to select washing machine cycles and features. In response to user manipulation of the user interface input, the controller 138 operates the various components of the machine 10 to execute selective machine cycles and features. As will be described in more detail below, the controller 138 is operatively coupled to the drive system and the spray device 40. The controller 138 can be configured to operate the spray device 40 to spray an initial amount of water onto a wash load received in the basket 32 and to operate the drive system to rotate the basket to urge the wash load radially outwardly within the basket prior to washing the wash load.

As will also be described in more detail, the controller 138 can be further configured to operate the drive system to rotate the basket 32 at a first slower speed and, subsequently, at a second higher speed after operating the spray device 40 to spray the initial amount of water onto a wash load received in the basket 32. Still further, the controller 138 can be configured to operate the drive system to rotate the pulsator 116 to impart a rollover action to the wash load for washing thereof and/or can be configured to operate the spray device 40 to spray a wash amount of water onto the wash load after operating the drive system to rotate the basket 32 to urge the wash load radially outwardly.

Figure 3:
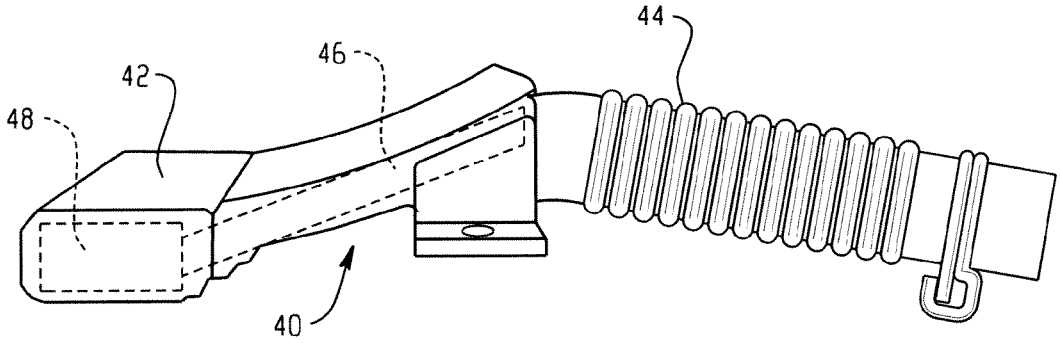
FIG. 3 is a side view of the spray fill device.
Figure 4:
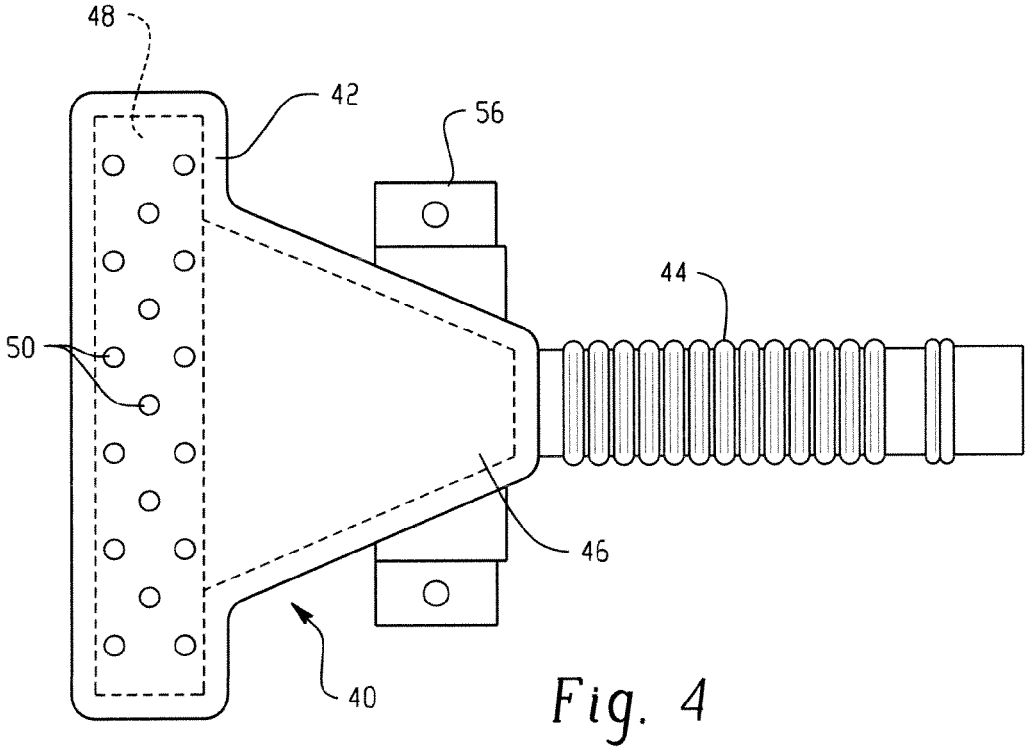
FIG. 4 is a top view of the spray fill device of FIG. 3.

As best shown in FIG. 1, the spray fill device 40 can be positioned to direct spray water therefrom toward or adjacent the central axis 118 of the basket 32. With reference to FIGS. 3 and 4, the spray fill device 40 can include a body 42 and a water pipe 44 coupled with the body for supplying water thereto. In an exemplary embodiment, the body 42 can be substantially triangular in shape, and include a water inlet 46 defined at an end thereof, an elongated channel 48 defined at another end thereof and being in flow communication with the water inlet 46, and a plurality of outlet apertures 50 defined in flow communication with the channel 48. The water inlet 46 is coupled in flow communication with the water pipe 44 for supplying water to channel 48 therethrough. The body 42 further includes an elongated mounting portion 56 formed thereon, which is configured to mount the spray fill device 40 onto the washing machine 10 and above the basket 32. In particular, in one exemplary embodiment, the spray fill device 40 can be positioned to direct spray water therefrom toward or adjacent the central axis 118 of the basket 32. In one embodiment, the outlet apertures 50 are defined on the body 42 at varying angles with respect to a horizontal plane when the spray filled device 40 is mounted in the washing machine 10. Specifically, the outlet apertures 50 can be defined on the body 42 at varying angles with respect to the horizontal plane. In another embodiment, the outlet apertures 50 can be defined on the body 42 at a uniform angle with respect to the horizontal plane.

Figure 5:
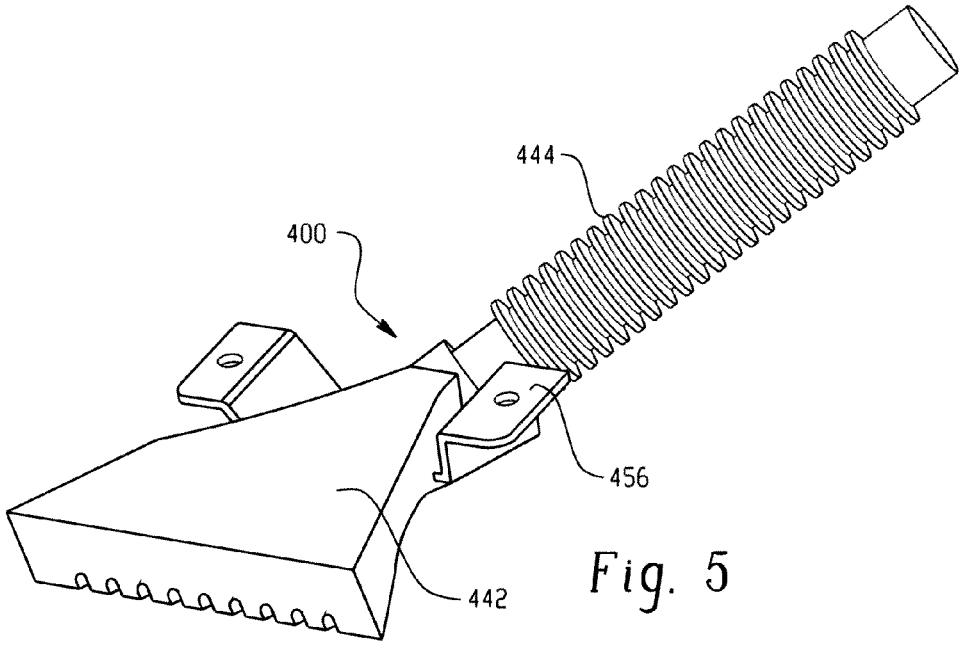
FIG. 5 is a perspective view of another spray fill device
Figure 6:
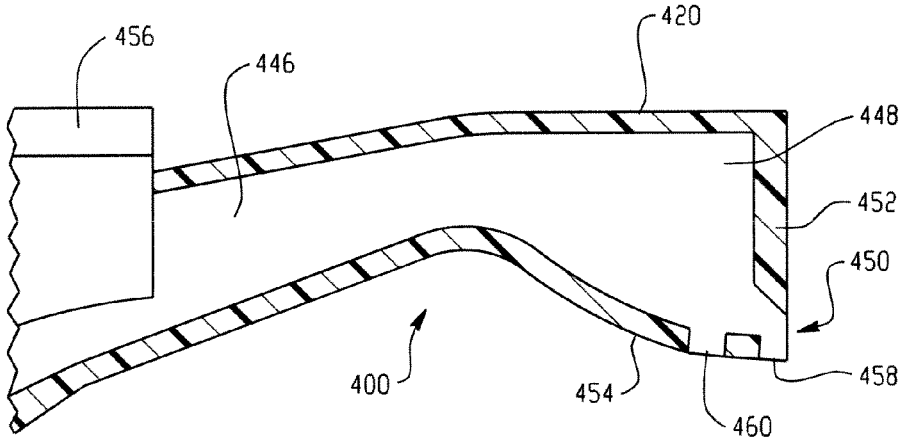
FIG. 6 is a partial cross-section of the spray fill device of FIG. 5.

With reference to FIGS. 5 and 6, a spray fill device 400 is shown according to an alternate embodiment. Similar to the spray fill device 40, the spray fill device 400 of FIGS. 5 and 6 includes a body 420 and a water pipe 444 coupled with the body 420 for supplying water thereto. The body 420 can be substantially triangular in shape, and include a water inlet 446 defined at an end thereof, an elongated channel 448 defined at another end thereof and being in flow communication with the water inlet 446, and a plurality of outlet apertures 450 defined in flow communication with the channel 448. The water inlet 446 is coupled in flow communication with the water pipe 444 for supplying water to channel 448 therethrough. The body 442 can further include an elongated mounting portion 456 formed thereon, which is configured to mount the spray fill device 400 onto washing machine 10 above basket 32, such as to direct spray toward or adjacent the central axis 118 of the washing machine 10.

As best shown in FIG. 6, the body 420 can include a forward wall 452 and an underside wall 454. At least some of the outlet apertures 450 can be formed at an intersection of the forward wall 452 and the underside wall 454 to simultaneously direct water forwardly and downwardly relative to the body 420. More particularly at least some of the outlet apertures 450 can form a first row of apertures 458 (i.e., the apertures formed at the intersection of the forward wall 452 and the underside wall 454) and at least some further of the outlet apertures, specifically those defined in the underside wall 454 that are spaced apart from the first row of apertures 458, can form a second row of apertures 460.

The controller 138 operates the various components of the washing machine 10 in a designated wash cycle familiar to those in the art of washing machines. However, and unlike known washing machines, the controller 138 operates the washing machine 10 in a manner to redistribute a wash load held in the rotatable basket 32 for promoting more rapid turnover of the wash load.

Figure 7:
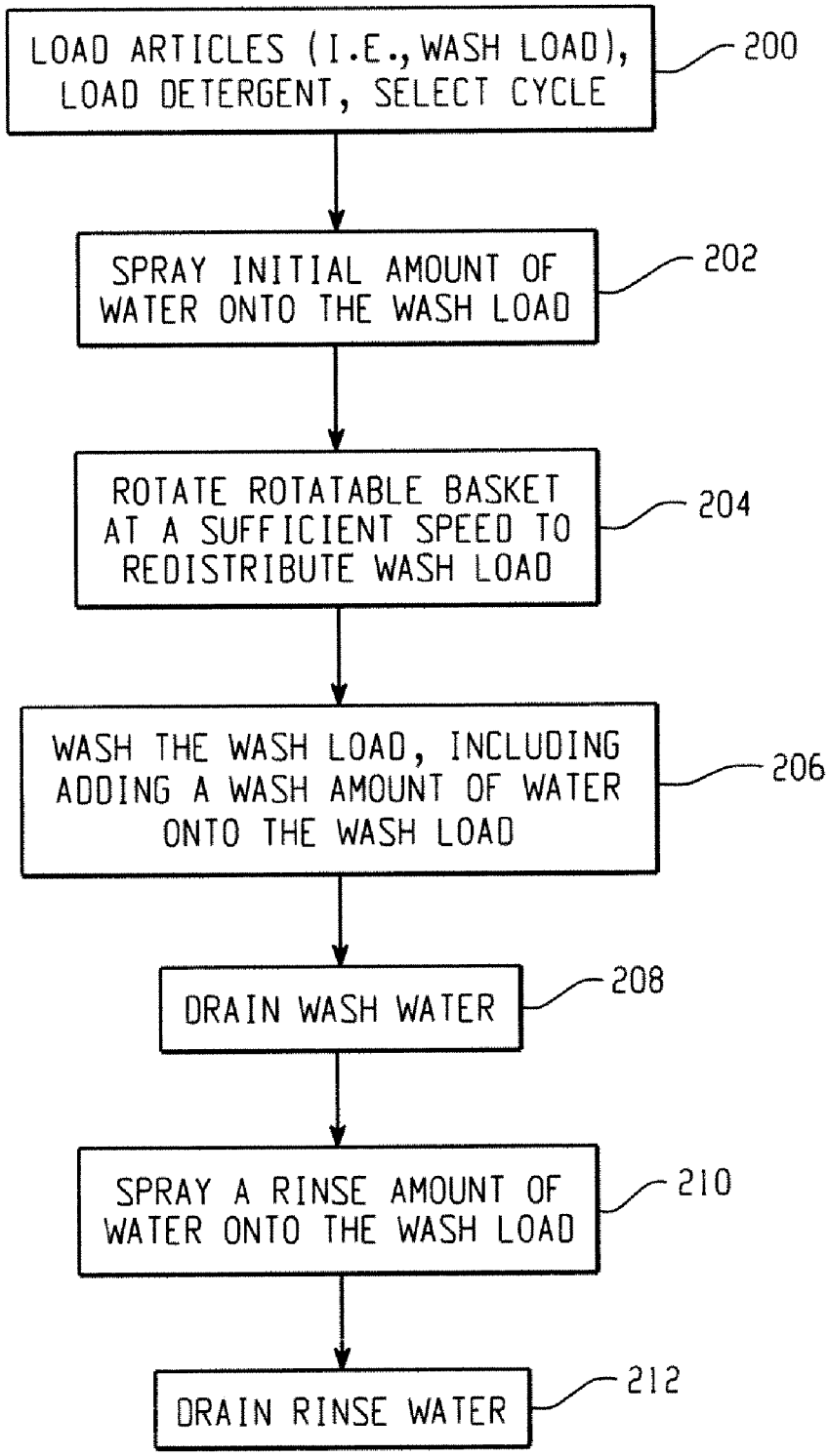
FIG. 7 is a block flow diagram illustrating a method.

FIG. 7 illustrates, in general terms, a wash cycle used to wash a wash load in the washing machine 10 and incorporates a method for redistributing the wash load held in the rotatable basket 32 for promoting turnover. The first step 200 in the wash cycle involves a wash load being introduced to the interior of the drum or tub 30. Detergent can also be added in step 200. The specific characteristics of the wash cycle to be carried out by the washing machine 10 (e.g., temperature, spin speed, load, etc.) can also be selected by the user during this first step 200. It will be appreciated that the components of step 200 can be carried out in any order and over any appropriate and desired timeframe.

Next, in step 202, an initial amount of water (e.g., about 2-3 gallons) is sprayed onto the wash load from the spray device 40 of the wash machine 10. Alternatively, the initial spray can occur through alternate conduit 114. This spraying of an initial amount of water onto the wash load imparts a mass to the wash load that is held in the rotatable basket 32. The spraying of an initial amount of water in step 202 can include directing the initial amount of water toward at least a center (i.e., at axis 118) of the rotatable basket 32 directing the initial spray toward the center of the basket 32 can cause the entire wash load to be wetted since the basket 32 will be spinning at least 360 degrees. Concurrent with or subsequent to step 202, the rotatable basket 32 can be rotated to redistribute the wash load radially outwardly in the basket 32. In particular the wash load is centrifugally redistributed within the basket 32 by the centrifugal forces acting on the wash load as the basket 32 is rotated. The rotation of the basket 32 in step 204 can specifically include rotation of the basket 32 at a first slower speed (e.g., 15 RPM) to ensure even water distribution to the wash load and, subsequently, after the spraying of the initial amount of water in step 202, can include rotating the rotatable basket 32 at a second higher speed (e.g., 350 RPM) to force the wash load radially outwardly. Rotating the rotatable basket 32 at the first slower speed ensures even water distribution throughout the wash load, whereas rotating the rotatable basket at the second higher speed causes the redistribution of the wash load radially outwardly. In addition, the rotating of the rotatable basket 32 at the second higher speed can include rapidly accelerating the basket 32 to the second higher speed to avoid any undue delay in redistributing the wash load.

After the rotatable basket 32 is rotated to redistribute the wash load, the wash load is washed within the basket 32 (i.e., the washing machine 10 proceeds to carry out the wash step) (Step 206). This can, if required by the user, involve a prewash. The wash step 206 can include introducing water and detergent to the tub 30 and the basket 32 though this is normally performed during steps 200 and/or 202. If desired, the basket 32 can then be rotated about the axis 118 at low speeds (e.g., 30-40 RPM) so as to tumble the wash load in the water and detergent, though this is not required. During the washing step 206, the wash load can be agitated by the element 34, whether an agitator, pulsator, oscillator or other similar device within the basket 32 to wash the wash load. Where the device is a pulsator, such as pulsator 116, rollover action 160 (FIG. 2) can be imparted to the wash load by the pulsator 116. Of course, during the wash step 206, a wash amount of water can be sprayed onto the wash load from the spray device 40 for washing the wash load. The wash amount of water can correspond to a setting input by a user of the machine 10 or through automatic load size detection thereby providing a sufficient quantity of water to wash the articles of the wash load.

The rollover action 160 imparted to the wash load can include an initial rollover. Rotating the rotatable basket 32 to redistribute the wash load in step 204 reduces the time in which this initial rollover occurs, particularly in washing machines employing pulsators such as pulsator 116. Next the wash amount of water is drained from the tub 30 (step 208). This can occur with or without a spin extraction step. Then, a rinse amount of water can be sprayed onto the wash load from the spray device 40 for rinsing the wash load and/or the basket 32 can be rotated to remove the rinse amount of water from the wash load (Step 210), commonly referred to as a spin cycle. After rinsing, the rinse amount of water can be drained from the tub 30 (step 212). These steps 210 and 212 can be repeated any number of desired times.

Distributing the wash load to the outside of the basket 32 in step 204 results in the wash load, and particularly the individual items of the wash load, to begin turning over or rolling over sooner than if the wash load were just placed randomly in the washing machine 10 by a consumer. This advantage (i.e., earlier turning over of the wash load) is particularly useful in pulsator-type washing machines (such as the washing machine illustrated in FIG. 2). Particularly, faster turnover or rollover can yield a better wash and wear performance.

The exemplary embodiment or embodiments have been described with reference to preferred embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

What is claimed is:

1. A method for redistributing a wash load held in a rotatable basket of a washing machine for promoting turnover, comprising:

spraying an initial amount of water onto the wash load from a spray device of the washing machine, the initial amount of water only without detergent is approximately 2-3 gallons to increase a mass of the wash load;

directing said initial amount of water toward a central rotational axis of said rotatable basket;

rotating the rotatable basket to redistribute the wash load radially outwardly in the basket as a result of the increased mass from the spraying step including rotating the rotatable basket at a first slower speed to ensure even water distribution to the wash load and subsequently, after said spraying of said initial amount of water, rotating said rotatable basket at a second higher speed to force the wash load radially outwardly; and after said rotating the rotatable basket to redistribute the wash load, washing the wash load within said basket to wash the wash load.

2. The method of claim 1 wherein said rotating said rotatable basket at said second higher speed includes rapidly accelerating said basket to said second higher speed.

3. The method of claim 1 wherein said washing the wash load includes agitating the wash load within said basket to wash the wash load.

4. The method of claim 3 wherein said agitating includes agitating with a pulsator to impart rollover action to the wash load.

5. The method of claim 1 wherein said washing includes:

spraying a wash amount of water onto the wash load from said spray device for washing the wash load; and imparting rollover action to the wash load for washing thereof.

6. The method of claim 5 wherein said rollover action includes an initial rollover and said rotating said rotatable basket to redistribute the wash load.

7. The method of claim 1 further including, after said washing of the wash load, one or both of:

spraying a rinse amount of water onto the wash load from said spray device for rinsing the wash load; and rotating said basket to remove said rinse amount of water from the wash load.

8. The method of claim 1 wherein the first slower speed is about 15 rpm and the second higher speed is about 350 rpm.

9. A method for redistributing a wash load held in a rotatable basket of a washing machine for promoting marc rapid turnover, comprising:

imparting an initial amount of water only without detergent to the wash load toward the center of said rotatable basket and increasing the mass of the wash load with the initial amount of water;

rotating the basket at least 360 degrees at a first speed of approximately 15 RPMs to ensure even water distribution;

redistributing the wash load centrifugally within said basket by accelerating and rotating the basket to a second speed, no greater than 350 RPMs to force the wash load radially outward; and after said redistributing, imparting rollover action to the wash load utilizing a pulsator for washing thereof.

10. The method of claim 9 wherein, the initial amount of water comprises about 2-3 gallons.

* * * * *